US005464111A

United States Patent [19]

Vacek et al.

[11] Patent Number: 5,464,111

[45] Date of Patent: Nov. 7, 1995

[54] CLOSURE FOR MEDICATION CONTAINER

[75] Inventors: Ronald R. Vacek, Rochester; Bruce Semmler, Spencerport; Edward Owens, Rochester, all of N.Y.

[73] Assignee: Sterling Winthrop, Malvern, Pa.

[21] Appl. No.: 25,481

[22] Filed: Mar. 3, 1993

[51] Int. Cl.[6] ..... B65D 53/04

[52] U.S. Cl. ..... 215/249; 220/258; 604/415

[58] Field of Search ..... 215/249, 247; 220/258; 604/415

[56] References Cited

U.S. PATENT DOCUMENTS

| | | | |
|---|---|---|---|
| 2,601,091 | 6/1952 | Butler . | |
| 3,358,865 | 12/1967 | Andersen . | |
| 4,152,378 | 5/1979 | Vcelka et al. | 220/258 |
| 4,524,809 | 6/1985 | Dent | 604/415 |
| 4,632,673 | 12/1986 | Tiitola et al. | 604/425 |
| 4,793,504 | 12/1988 | Towns et al. | 220/258 |
| 4,863,453 | 9/1989 | Berger et al. | 604/415 |
| 5,060,812 | 10/1991 | Ogle, II . | |
| 5,125,921 | 6/1992 | Duschek . | |
| 5,158,192 | 10/1992 | Lataix | 220/258 |

FOREIGN PATENT DOCUMENTS

| | | |
|---|---|---|
| 116429 | 8/1984 | European Pat. Off. . |
| 86 13 068.4 | 8/1986 | Germany . |

*Primary Examiner*—Joseph Man-Fu Moy
*Attorney, Agent, or Firm*—Fish & Richardson

[57] ABSTRACT

In accordance with this invention, there is provided a closure arrangement for medication containers comprising an elastomeric stopper comprising a tear-away member which blocks a passageway defining a conical luer taper and a cap comprising means for engaging the tear-away member, whereby the engaged tear-away member can be readily torn away by a user by rotating the cap or by pulling the cap off the container in an axial direction. The closure arrangement reduces the risk of particulate contamination associated with stoppers adapted to be ruptured with a luer nozzle.

2 Claims, 6 Drawing Sheets

CLOSURE FOR MEDICATION CONTAINER

FIELD OF INVENTION

This invention relates to a closure arrangement adapted for use with a medication container.

BACKGROUND OF THE INVENTION

Various closure arrangements for medication containers are known in the art. Medication container closures have been adapted, e.g., to be pierced by a hypodermic needle or ruptured by a sharp spike.

For example, U.S. Pat. No. 5,125,921 describes a closure arrangement for pharmaceutical bottles containing a stopper closing the bottle mouth and a closure cap mounted over the bottle mouth. The stopper is adapted to be pierced with a hollow needle. The closure cap is provided with a tear-off disc which is above the stopper and is removable upon opening the closure. The tear-off disc is produced from plastic material in one piece with the closure cap and is retained by means of a weakening line. When the closure cap is pressed in the direction toward the bottle, the tear-off disc is separated from the closure cap and the stopper is free for insertion of a hollow needle. However, this arrangement is not adapted for use with a luer fitting.

In order to avoid problems associated with the handling of sharp needles and spikes, medication containers have been provided with stoppers which can be ruptured by the luer fitting or nozzle of a conventional hypodermic syringe. After the nozzle penetrates the stopper in the medication container, medication can be loaded into the syringe. Thereafter, the syringe can be connected to a safe hypodermic needle or a safe intermittent cap for direct intravenous injections. For example, U.S. Pat. No. 5,060,812 describes a medication container stopper which can be punctured by the luer nozzle of a hypodermic syringe. However, a significant problem with rupturable containers of this type, regardless of whether they are designed for use with spikes or luer fittings, is that particulates generated by the rupturing process are directed into the container, often providing a source of unacceptable contamination.

It would be desirable to provide a closure management for a medication container which reduces the risk of particulate contamination, and which is easily manipulated by the user.

SUMMARY OF THE INVENTION

This invention provides an improved stopper-cap closure arrangement for use with medication containers.

More specifically, in accordance with this invention, there is provided a closure arrangement for medication containers, the closure arrangement comprising:

a) an elastomeric stopper adapted to make a friction fit in an opening of the medication container, the stopper having an exterior surface, the exterior surface of the stopper comprising a tear-away member formed integrally with the stopper, the interior surface of the stopper having a blocked passageway which opens away from the exterior surface of the stopper and defines a conical taper, the passageway being blocked by the tear-away member, and b) a cap comprising means for engaging the tear-away member, whereby said engaged tear-away member can be torn away by rotating or removing the cap.

It is a particularly advantageous feature of this invention that the tear-away member can be engaged by the cap and readily torn away by rotating and/or removing the cap, thereby opening the passageway with reduced risk of particulate contamination, thus enabling the user to pour fluid medication through the passageway or insert a luer nozzle into the passageway.

Yet another advantageous feature of this invention is that there is provided a stopper-cap closure arrangement for a medication container which can be easily and economically manufactured and readily used.

Other advantages will become readily apparent upon reference to the following discussion of preferred embodiments when read in light of the accompanying drawings.

DESCRIPTION OF PREFERRED EMBODIMENTS

While this invention is described hereinafter particularly with respect to a stopper-cap closure arrangement for use with a medication container, it also finds utility in connection with closure arrangements for other fluid-containing vessels.

Commonly-owned U.S. patent application Ser. No. 08/025,480, entitled STOPPER FOR MEDICATION CONTAINER, filed on even date herewith, describes a dual use stopper for a medication container featuring a tear-away member which can be removed to reveal a conical taper adapted to have a luer cone inserted therein for removal of the medication fluid from the container. The tear-away member can be removed by the user. However, for certain rubbery elastomeric materials, it can be difficult for the user to easily remove the tear-away member from the stopper. The present invention provides an improvement wherein the tear-away member can be simply and effectively removed from the stopper, even when the stopper is fabricated of rubbery elastomeric materials.

Figure 1:
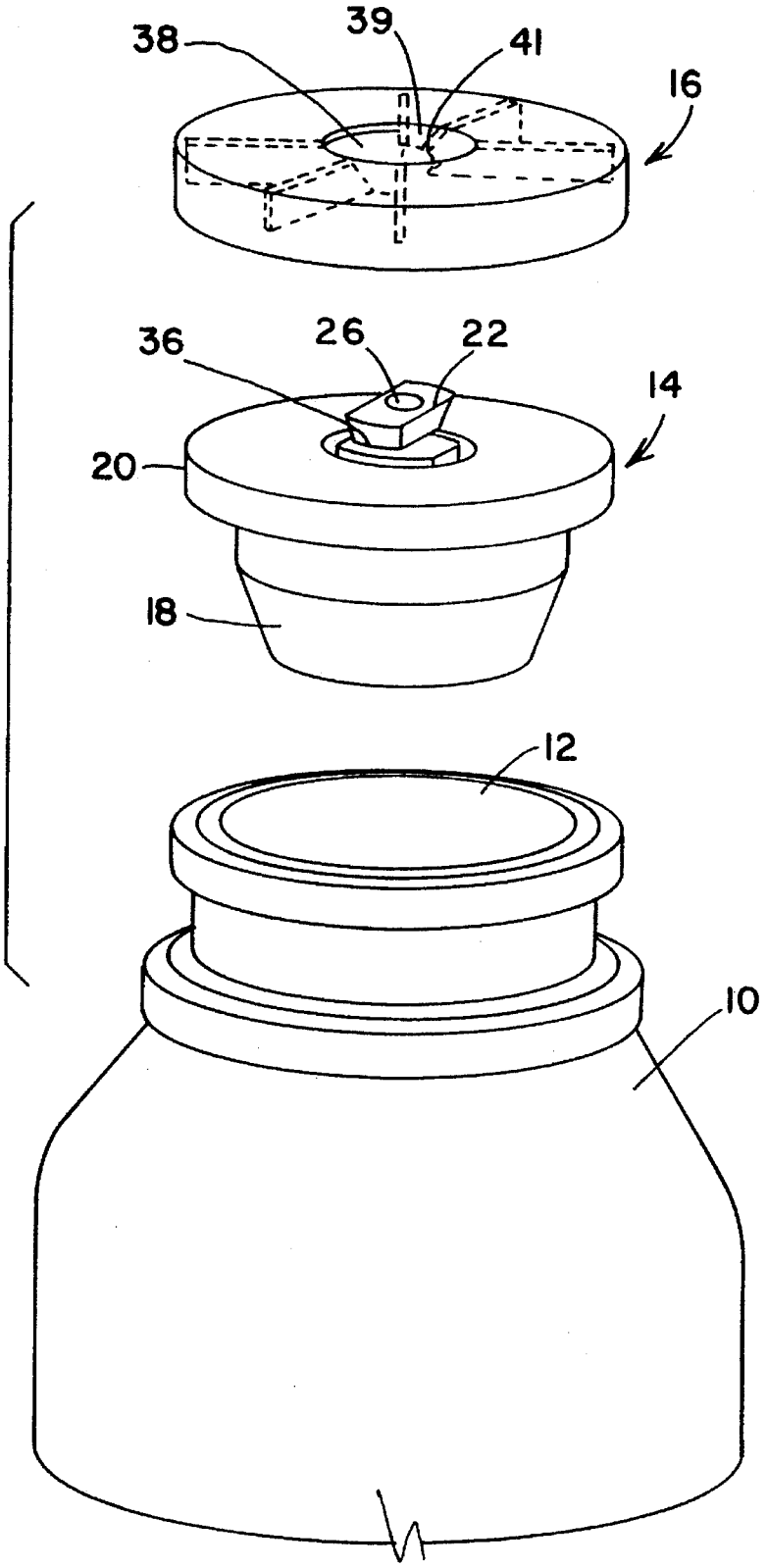
FIG. 1 is a perspective view of an unassembled stopper-cap closure arrangement of the invention and a portion of an associated medication container.
Figure 2:
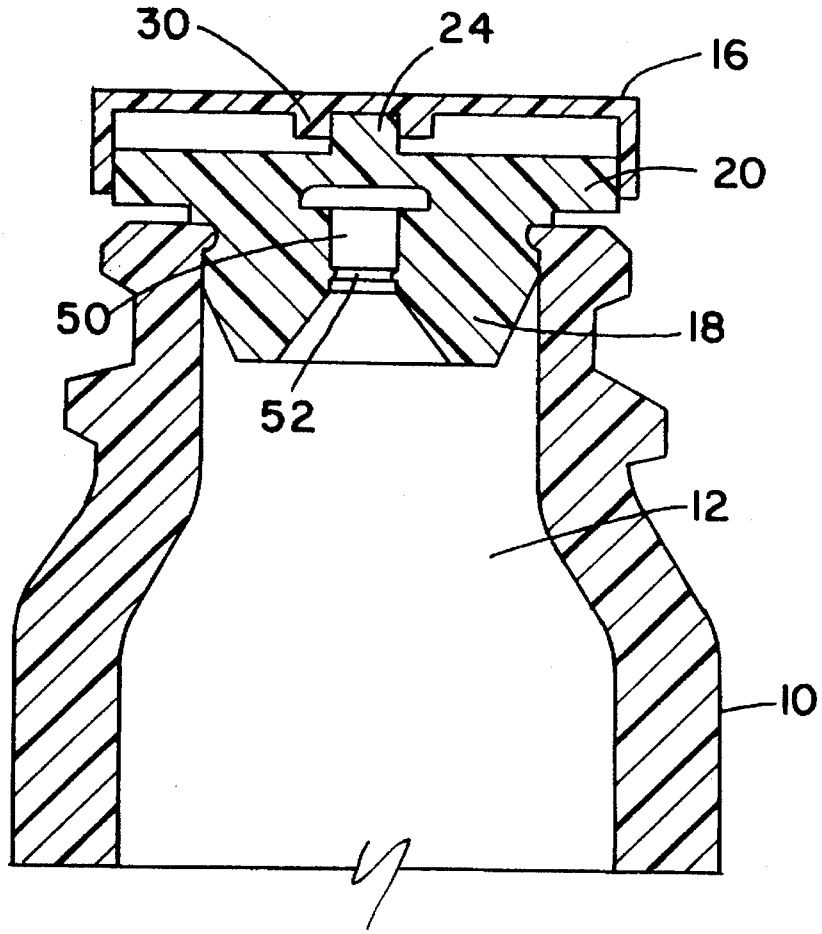
FIG. 2 is a cross-sectional view of an assembled stopper-cap closure arrangement of the invention.

With reference to FIGS. 1 and 2, the closure arrangement of this invention is intended for use in combination with a conventional medication container 10, formulated of glass or plastic, having an opening 12. The closure arrangement comprises an elastomeric stopper 14 and a cap 16. In a preferred embodiment, the stopper is a dual use stopper of the type described in U.S. patent application Ser. No. 08/025,480 entitled STOPPER FOR MEDICATION CONTAINER, the disclosure of which is hereby incorporated by reference in its entirety. The stopper preferably has a neck portion 18 which is adapted to make a friction fit in the opening of the medication container and a flange portion 20. The stopper has an exterior surface adapted to face away from the container and an interior surface adapted to face toward the container interior. The exterior surface of the stopper comprises a tear-away member 22, which preferably is formed integrally with the stopper. The tear-away member has an exterior surface facing away from the container and an interior surface facing toward the container interior, which can define opposite faces of a thin diaphragm 24, preferably formed integrally with the plug. The exterior surface of the tear-away member can be provided with a raised circular rib 26, which functions as a target ring for the needle.

In accordance with this invention, the cap comprises means for engaging the tear-away member. Such means for engaging the tear-away member can take a variety of forms, as described below. The cap can be engaged with the tear-away member, e.g., by rotating the cap or by pulling the cap off the container using an axial motion, i.e., away from the container.

Figure 3:
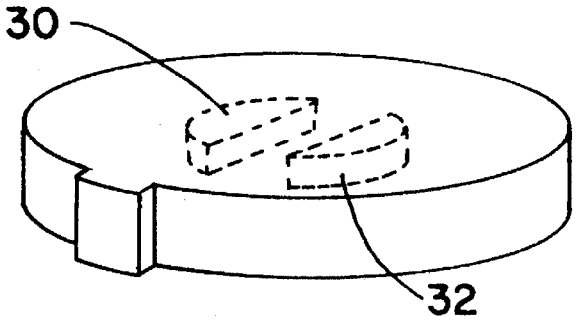
FIGS. 3 and 4 are perspective views of caps in accordance with the invention.
Figure 5:
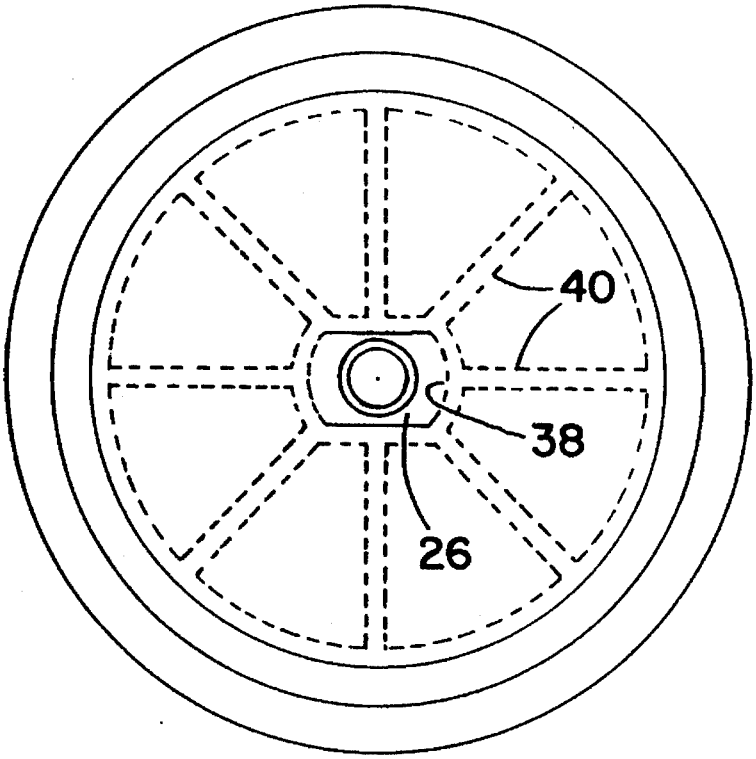
FIG. 5 is a top view of an embodiment of the invention.

For example, as depicted in FIGS. 2 and 3, the underside of the cap can contain a keying element 30 which is adapted to engage the tear-away member when the cap is rotated. The keying element can comprise a pair of arcuately shaped ribs 32, which must be appropriately aligned with the tear-away member during assembly.

Figure 4:
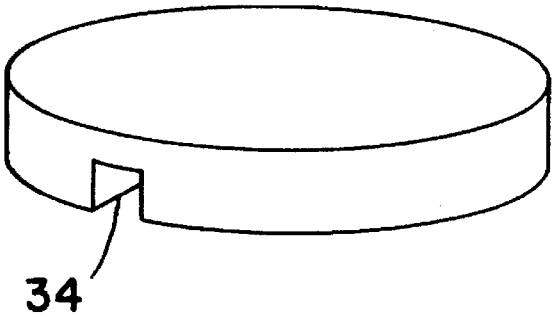

In another embodiment, the cap has an outer rim which contains an aperture 34 (FIG. 4) which is adapted to engage the tear-away member when the cap is removed. In this and other embodiments, the tear-away member preferably has a tapered throat 36 to facilitate engagement. When the cap is used as a tool, an advantage is provided that the cap need not be oriented with respect to the stopper during assembly.

In a further embodiment of the invention, the cap has an opening 38, and an inside rim 39 preferably containing a shelf portion 41 adapted to engage the necking up portion of the tear-away member above the throat when the cap is pulled off the container using an axial motion. The opening can take the form of, e.g., a rectangle, an hour glass, a bow-tie and the like. The opening must be aligned to fit over the tear-away member during assembly. The cap can be provided with ribs 40 for improved rigidity and/or structural integrity. The shelf portion can be positioned under the tear-away member by rotating the cap.

Figure 6:
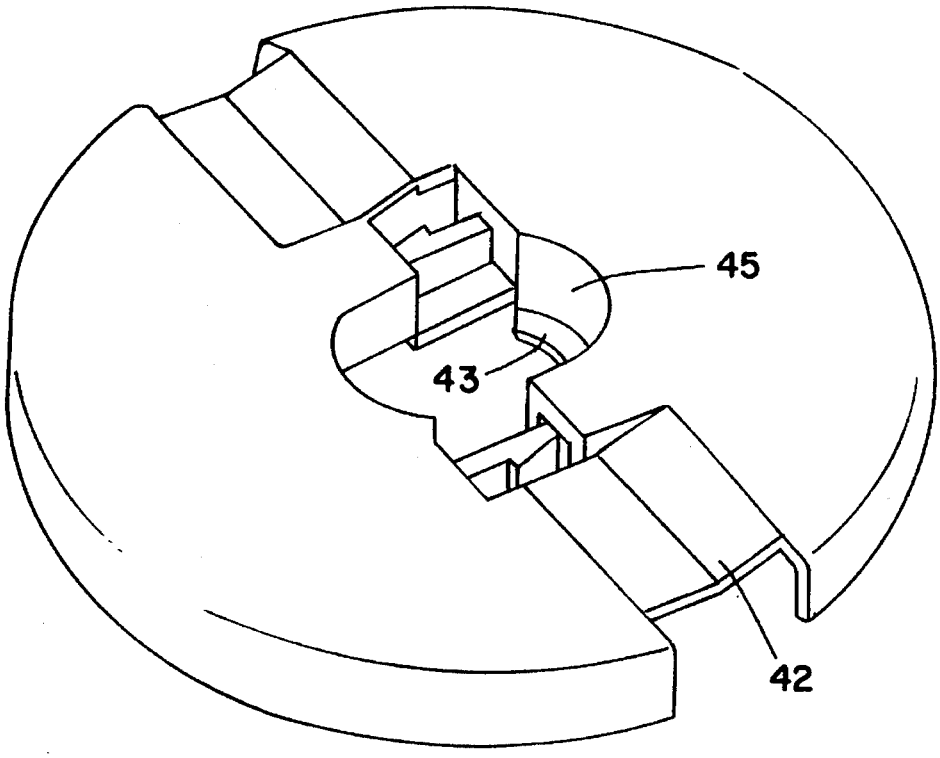
FIGS. 6 and 7 are top and bottom perspective views of a collapsible cap in accordance with this invention.
Figure 7:
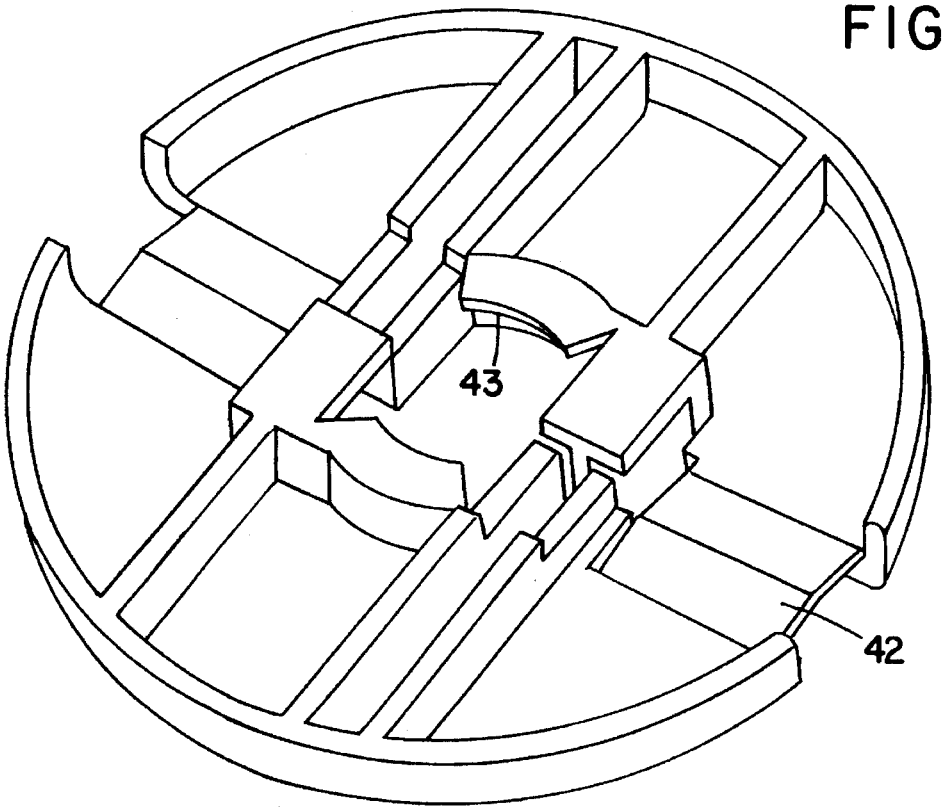

In yet another embodiment of the invention, the cap can be squeezed by the user to engage the tear-away member. As depicted in FIGS. 6 and 7, the cap can contain a V-shape bias about a collapsible center line 42. The shelf portion 43 of inside rim 45 engages the tear-away member when the cap is squeezed by the user. Once actuated, the cap is pulled off by the user using an axial motion. An advantage of such embodiment is that the cap does not need to be specifically oriented with respect to the stopper during assembly.

Figure 8:
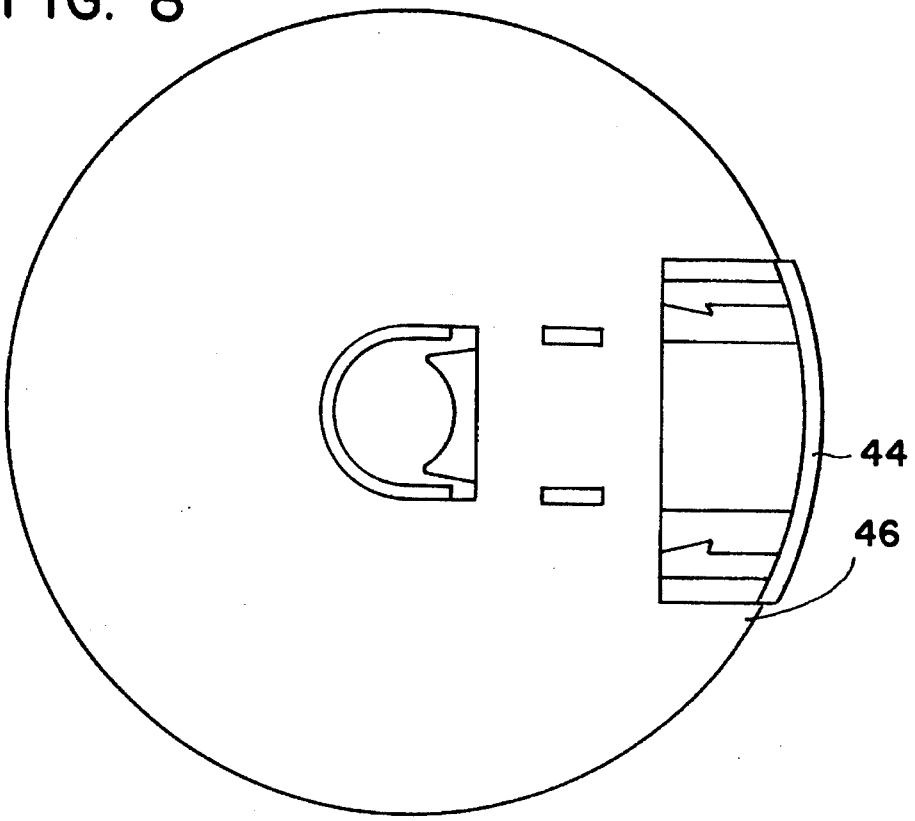
FIGS. 8 and 9 are top and bottom perspective views of a cap in accordance with this invention featuring a slidable member.
Figure 9:
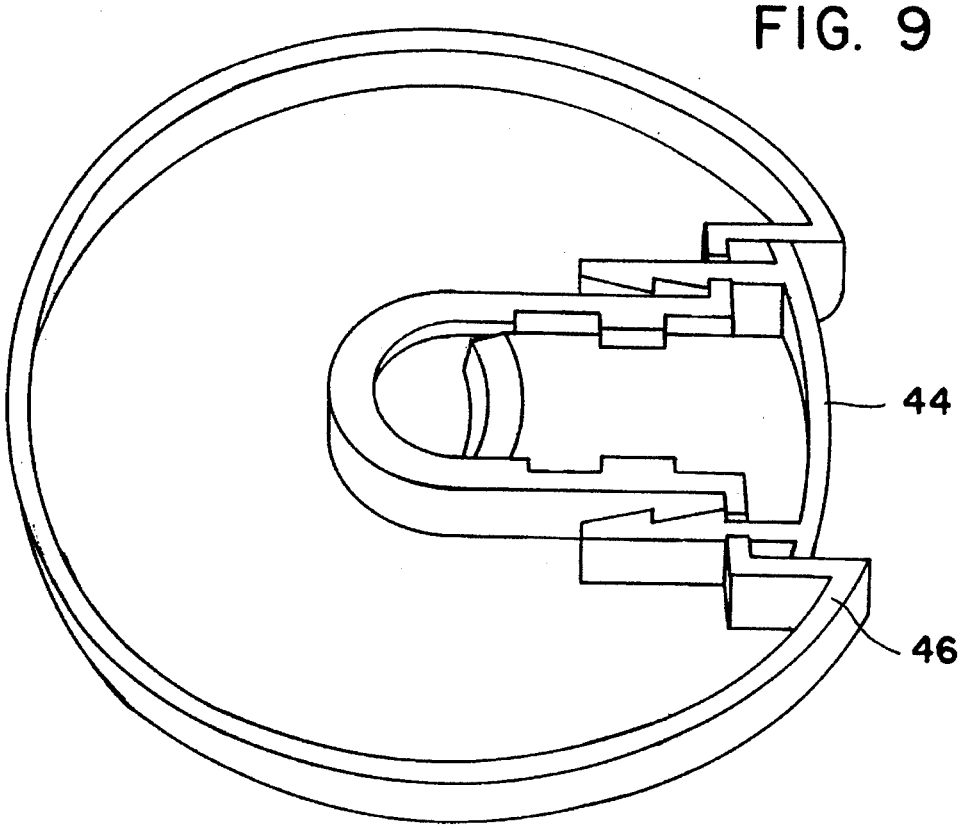
Figure 10:
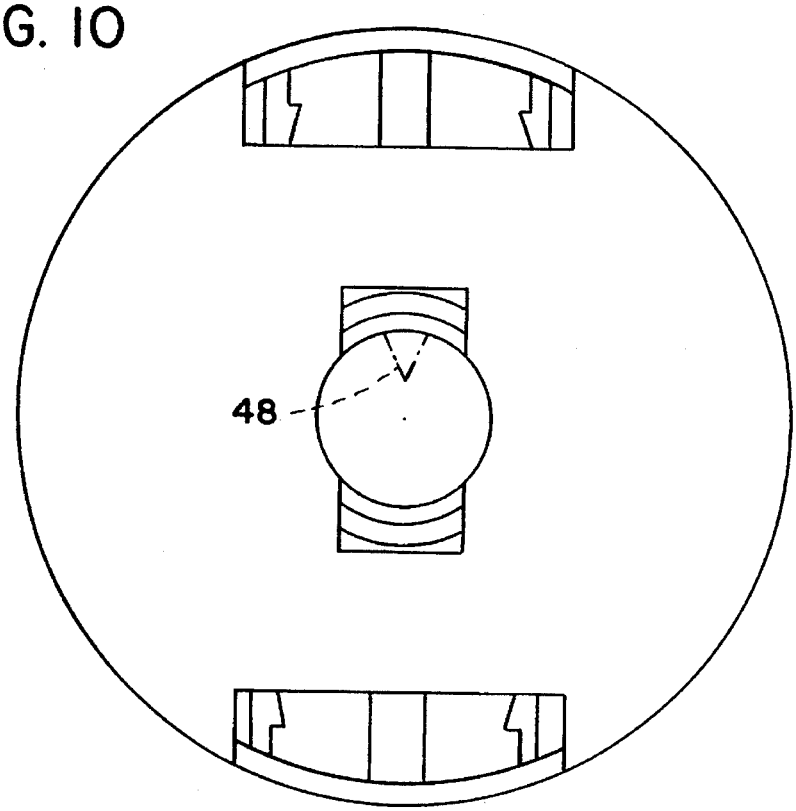
FIGS. 10 and 11 are top and bottom perspective views of a cap in accordance with this invention featuring a pair of slidable members.
Figure 11:
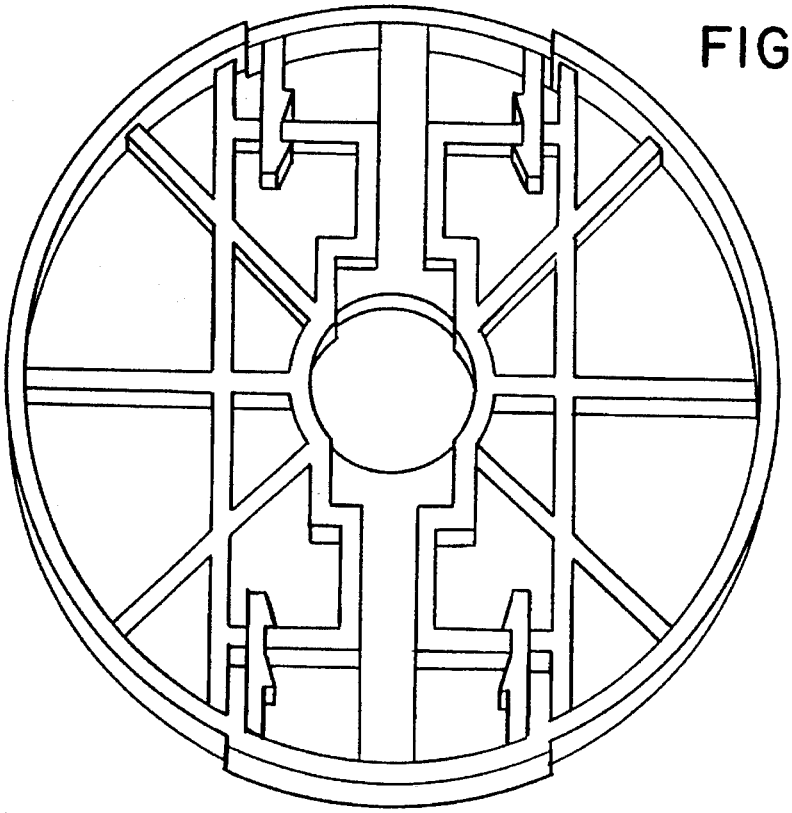

In still another embodiment of the invention as depicted in FIGS. 8 and 9, the cap can comprise a slidable member 44. The slidable member can contain a barb 46. When the slidable member is actuated by the user to engage the tear-away member, the barb locks the slidable member in an engaged position. FIGS. 10 and 11 depict a cap featuring a pair of slidable members, each of which can contain a pair of barbs which lock the sliding members in engagement with the tear-away member upon actuation by the user. The engaging surface of the sliding member can contain a spear 48 depicted in phantom in FIG. 10 which penetrates or weakens the fracture area of tear-away member when the sliding member is engaged, thus facilitating removal of the tear-away member. After the slidable members are actuated, the cap can be pulled off by the user. Caps featuring slidable members are advantageous in that no particular orientation of the cap with respect to the stopper is required during assembly. However, the multi-component parts can add additional expense and complexity to the manufacturing process.

When the means for engaging the tear-away member are engaged and the cap is removed, the tear-away member is torn away at a fracture area, revealing the blocked passageway. The relative size of the cap as compared to the tear-away member provides a significant mechanical advantage in the tear-away process. This provides a closure arrangement which is easily opened by the user.

The interior surface of the stopper has a blocked passageway 50 which opens away from the exterior surface of the stopper and defines a conical taper. The passageway is blocked by the interior surface of the tear-away member. The passageway is designed to fulfill the specifications for a standardized female cone, preferably a standard luer female cone as described in accordance with ANSI/HIMA MD 70.1-1983. The female cone is intended to be connected to a standard male cone of an injection syringe. This connection of conical fittings makes it possible to transfer a solution from the container directly into the syringe without any intermediate steps or means. The female cone preferably has a maximum opening diameter smaller than 1.0 cm, preferably from 0.2 to 0.8 cm.

The tear-away member can be removed without deforming the luer cone, thus forming a conventional luer lock port. This provides a stopper which can receive a standard male nozzle luer conical tip (not shown in the drawings) on an injection syringe without leakage. It is an advantageous feature of this invention that any particulates generated by removing the tear-away member are directed away from the medication in the container, thus reducing the risk of particulate contamination.

The diaphragm preferably is of a thickness which permits the diaphragm to be ruptured by inserting a hypodermic needle therethrough. The thickness of the diaphragm preferably is about 0.005 to 0.200 inches (0.013–0.50 cm), more preferably 0.050 to 0.150 inches (0.13–0.38 cm). The thickness preferably is selected so that coring, i.e. generation of particulates, during the puncturing process is minimized and so that the needle is retained with a leak proof seal.

In still another embodiment of this invention, the neck portion of the passageway can be recessed within the body of the stopper. This provides a stopper of reduced size, which can be advantageous from the standpoint of manufacturing, shipping and handling.

In a preferred embodiment, the interior surface of the passageway can be provided with an annular protrusion 52 to facilitate the formation of a leak proof seal when the male nozzle is inserted into the female cone. Such protrusion is particularly desirable when the system is used at a pressure greater than atmospheric pressure.

The cap can be fabricated of various synthetic plastic materials such as polyethylene or polypropylene. If the system is to be sterilized, e.g., by autoclaving, the cap material preferably permits passage of the steam.

The stopper can be fabricated of elastomeric materials known in the art. Examples of suitable elastomeric materials can be selected from synthetic rubbers, natural rubbers, butyl rubbers and the like. The elastomeric material preferably is a synthetic rubber with a Shore hardness of between about 45 and 55.

The stopper preferably is a unitary structure. This enables the stopper to be efficiently and economically manufactures and this is commercially advantageous compared to complex multi-part stoppers.

The invention has been described in detail with particular reference to certain preferred embodiments thereof, but it will be understood that variations and modifications can be effected within the spirit and scope of the invention.

We claim:

1. A closure arrangement for medication containers, said closure arrangement comprising:

a) an elastomeric stopper adapted to make a friction fit in an opening of the medication container, the stopper having an exterior surface, the exterior surface of the stopper comprising a tear-away member formed integrally with the stopper, the interior surface of the stopper having a blocked passageway which opens away from the exterior surface of the stopper and defines a conical taper, the passageway being blocked by the tear-away member, and b) a cap comprising means for engaging the tear-away member, whereby said engaged tear-away member can be torn away by rotating the cap.

2. The closure arrangement of claim 1 wherein said cap has an underside containing a keying element adapted to engage said tear-away member when the cap is rotated.

* * * * *